US006939116B2

(12) United States Patent
Yamaji et al.

(10) Patent No.: US 6,939,116 B2
(45) Date of Patent: Sep. 6, 2005

(54) SCROLL COMPRESSOR

(75) Inventors: Hiroyuki Yamaji, Sakai (JP); Katsumi Kato, Sakai (JP); Masahide Higuchi, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/495,547

(22) PCT Filed: May 6, 2003

(86) PCT No.: PCT/JP03/05670

§ 371 (c)(1),
(2), (4) Date: May 13, 2004

(87) PCT Pub. No.: WO03/106843

PCT Pub. Date: Dec. 24, 2003

(65) Prior Publication Data

US 2005/0112011 A1 May 26, 2005

(30) Foreign Application Priority Data

Jun. 17, 2002 (JP) ..... 2002-175429

(51) Int. Cl.[7] ..... F03C 2/00

(52) U.S. Cl. ..... 418/55.3; 418/55.1; 418/55.2; 464/102

(58) Field of Search ..... 418/55.3, 55.2, 418/55.1; 464/102

(56) References Cited

U.S. PATENT DOCUMENTS 4,904,170 A * 2/1990 Suefuji et al. ..... 418/55.2
5,318,424 A * 6/1994 Bush et al. ..... 418/55.2
5,516,267 A * 5/1996 Ikeda et al. ..... 418/55.3
5,836,752 A * 11/1998 Calhoun et al. ..... 418/55.2
6,120,269 A 9/2000 Iizuka et al.
6,273,691 B1 * 8/2001 Morimoto et al. ..... 418/55.2
6,312,236 B1 11/2001 Abe et al.
6,478,556 B2 * 11/2002 Choi et al. ..... 418/55.3
6,499,978 B2 * 12/2002 Cho et al. ..... 418/55.2
6,736,622 B1 * 5/2004 Bush et al. ..... 418/55.2

FOREIGN PATENT DOCUMENTS

JP 05-312156 A 11/1993
JP 06-37875 B2 5/1994
JP 07269478 A * 10/1995 ..... F04C/18/16
JP 10-184567 A 7/1998
JP 2001221169 A * 8/2001 ..... F04C/18/02
WO WO 99/63227 A1 12/1999

* cited by examiner

*Primary Examiner*—Theresa Trieu
(74) *Attorney, Agent, or Firm*—Shinjyu Global IP Counselors, LLP

(57) ABSTRACT

In a scroll compressor, a sliding direction of a Oldham coupling is defined such that an acting direction of an inertia force of the Oldham coupling is substantially opposite to an acting direction of a reaction force by gas compression, and thereby a range of fluctuation of a total torque of a first rotational torque acting on an orbiting scroll by the reaction force of gas compression and a second rotational torque of sliding movement of the Oldham coupling becomes smaller than that of the first rotational torque to suppress a noise and vibration caused by fluctuation of a rotational torque of the orbiting scroll without any limited designing of an involute shape thereof.

10 Claims, 8 Drawing Sheets

SCROLL COMPRESSOR

TECHNICAL FIELD

The present invention relates to a scroll compressor, and particularly to a technology of suppressing an operating noise and vibration caused by fluctuation of a rotational torque of an orbiting scroll.

BACKGROUND ART

Conventionally, a scroll compressor has been used as a compressor to compress a refrigerant in a refrigerating cycle, as disclosed, for example, in Japanese Laid-Open Patent Publication No. 5-312156. The scroll compressor includes a compression mechanism with a fixed scroll and an orbiting scroll that have protruding involute wraps engaged with each other in a casing. The fixed scroll is fixed to the casing by, for example, a fixing member (hereinafter, referred to as a housing) and the orbiting scroll is coupled to an eccentric shaft portion of a drive shaft. Further, the scroll compressor is constituted such that the orbiting scroll just revolves orbitally to the fixed scroll without rotating on its own axis, thereby contracting a compression chamber formed between the wraps of both scrolls to compress the refrigerant therein.

In the scroll compressor, for example, an Oldham coupling has been used to enable the above operation of the orbiting scroll. The Oldham coupling is provided with two pair of keys, which project at its obverse and reverse faces so as to cross each other at a right angle in a direction perpendicular to an axis of the drive shaft. Further, two pair of key grooves are formed at the outer face of the housing and the back face of the orbiting scroll so as to correspond to the above keys. Engagement of the keys with the key grooves prevents the orbiting scroll from rotating on its own axis during the rotation of the derive shaft, while continuous changing of the amount of movement in the direction of each key groove enables its orbital revolution around the rotational axis of the drive shaft.

A lateral-direction load and an axial-direction load act on the orbiting scroll as a reaction force of the refrigerant due to compressing of the refrigerant. Also, a rotational torque acts on the orbiting scroll due to the above lateral-direction load. The rotational torque, which includes a moment (herein, referred to as a first rotational torque) produced by a lateral-direction element of the refrigerant's reaction force as its main element, has a function of making the orbiting scroll rotate on its own axis. The first rotational torque increases or decreases cyclically depending on changing of a refrigerant's pressure in the compression chamber during the orbital revolution of the orbiting scroll, and it becomes the greatest when the orbiting scroll reaches to its revolutionary position where the refrigerant's pressure becomes the greatest.

Further, the rotational torque of the orbiting scroll changes its magnitude depending on moments caused by various factors such as a shape of wrap, a position of the center of gravity of the orbiting scroll, a manufacturing error between the rotational center and the wrap center, a changing inertia force by the movement of Oldham coupling, and operating conditions of the compressor (a moment caused by the inertia force of the Oldham coupling is referred to as a second rotational torque in the present description).

Problem to be Solved

In the meantime, in a so-called symmetric-volute structure having the same length of a fixed-side wrap as that of an orbiting-side wrap, the above rotational torque just changes only in its magnitude, having its unchanging acting direction. Meanwhile, in a so-called asymmetric-volute structure having a different length of the fixed-side wrap from that of the orbiting-side wrap, the rotational torque may not only change in its magnitude in a cycle but also reverse its acting direction. The reason for this is considered as follows. That is, a reaction force of the refrigerant's pressure in the first compression chamber formed between the wrap-outer peripheral face of the orbiting scroll and the wrap-inner peripheral face of the fixed scroll, and a reaction force of the refrigerant's pressure in the second compression chamber formed between the wrap-inner peripheral face of the orbiting scroll and the wrap-outer peripheral face of the fixed scroll may be basically balanced all the time during the orbital revolution of the orbiting scroll in the symmetric-volute structure. In the asymmetric-volute structure, however, there may exist an area where the above reaction forces are imbalanced.

Especially, in particular operating conditions such as a high-speed operation, the inertia force of the Oldham coupling becomes great, and thereby the direction of the rotational torque acting on the orbiting scroll tends to reverse. Accordingly, there was a problem that keys of the Oldham coupling shake in clearances in the key grooves of the hosing and the orbiting scroll, thereby producing a vibration and a noise.

The asymmetric-volute structure shows a tendency that the above vibration and noise occur more noticeably than the symmetric-volute structure. However, even the symmetric-volute structure have also a risk that the vibration of key may occur due to the fluctuation of the rotational torque, and therefore a stable operation with less torque vibration should be desirable for the symmetric-volute structure as well.

In the meantime, it may be possible to improve an involute shape of the wrap by design changing to reduce the rotational torque itself, and it is considered that this design changing may lessen the range of fluctuation of the rotational torque and the risk of the key shaking may reduce. In this case, however, there may be some possibility that design conditions, such as dimension or strength of wrap, or necessary compression characteristics, are not satisfied to the contrary. Accordingly, in fact it was very difficult to design simply to suppress only the rotational torque of the orbiting scroll.

The present invention has been devised in view of the above problems, and an object of the present invention is to suppress the noise and vibration caused by the fluctuation of the rotational torque of the orbiting scroll, without any limited designing of the wrap.

DISCLOSURE OF THE INVENTION

The present invention aims at suppressing the fluctuation of total rotational torque (T) by defining a relationship between a fluctuating cycle of the inertia force of the Oldham coupling (39), which is one of fluctuating factors of the above rotational torque (T), and a fluctuating cycle of the gas reaction force, in view of the fact that the fluctuation of the above inertia force behaves its action that is independent from the fluctuation of the gas reaction force.

Specifically, the present invention provides a scroll compressor including a fixed scroll (24), an orbiting scroll (26) and an Oldham coupling (39) in a casing (10) thereof, the orbiting scroll (26) forming a compression chamber (40) together with the fixed scroll (24), the Oldham coupling (39) being capable of sliding in a first direction that is perpendicular to an axis of a drive shaft (17) to the fixed scroll (24) and capable of sliding in a second direction that is perpendicular to the axis of the drive shaft (17) to the orbiting scroll (26).

Herein, in the scroll compressor defined in a first aspect of the present invention, the first direction is determined so as to provide a phase difference between a first rotational torque (T1) that acts on the orbiting scroll (26) with cyclic fluctuation by a reaction force of a gas in the compression chamber (40) during an orbital revolution of the orbiting scroll (26) and a second rotational torque (T2) that acts on the orbiting scroll (26) with cyclic fluctuation by sliding movement of the Oldham coupling (39) in the first direction, such that a range of fluctuation of a total torque (T) of the first rotational torque (T1) and the second rotational torque (T2) becomes smaller than that of the first rotational torque (T1).

As described above, the rotational torque (T) occurring during the orbital revolution of the orbiting scroll (26) is the total of moments that are produced by various factors, including the moment produced by a gas force, and it increases or decreases in magnitude cyclically with one cycle that is equivalent to one orbital revolution of the orbiting scroll (26). And, in the present invention defined in the first aspect, the reaction force of gas compression and the inertia force of sliding movement of the Oldham coupling (39) produce an action to make the range of fluctuation of the total torque (T) smaller than that of the first rotational torque (T1) during the orbital revolution of the orbiting scroll (26). Accordingly, this can prevent the orbiting scroll (26) from rotating on its own axis in the reverse direction during the orbital revolution of the orbiting scroll (26). Thus, any vibration of the Oldham coupling (39) does not occur easily and the orbital revolution of the orbiting scroll (26) is made stable.

Next, the present invention defined in a second aspect or a third aspect of the present invention defines a phase difference between the cyclic fluctuation of the first rotational torque (T1) and the cyclic fluctuation of the second rotational torque (T2) by an angle.

Specifically, according to the present invention defined in the second aspect, the first direction is determined so as to provide a phase difference of 150 °to 210 ° between cyclic fluctuation of a first rotational torque (T1) that acts on the orbiting scroll (26) by a reaction force of a gas in the compression chamber (40) during an orbital revolution of the orbiting scroll (26) and cyclic fluctuation of a second rotational torque (T2) by sliding movement of the Oldham coupling (39) in the first direction.

Further, according to the present invention defined in the third aspect, in the scroll compressor of the second aspect, the first direction of sliding movement of the Oldham coupling (39) is determined so as to provide a phase difference of substantially 180° between the cyclic fluctuation of the first rotational torque (T1) and the cyclic fluctuation of the second rotational torque (T2).

According to these present inventions defined by the second and third aspects, because the cyclic fluctuation of the first rotational torque (T1) by the gas reaction force during the orbital revolution of the orbiting scroll (26) and the cyclic fluctuation of the second rotational torque (T2) by the sliding movement of the Oldham coupling (39) have the above phase difference, an offsetting function by the first rotational torque (T1) and the second rotational torque (T2) occurs. Accordingly, the range of fluctuation of the total torque (T) can be made smaller than that of the first rotational torque (T1) by the gas reaction force. Thus, this can prevent the orbiting scroll (26) from rotating on its own axis in the reverse direction during the orbital revolution of the orbiting scroll (26), and thereby any vibration of the Oldham coupling (39) does not occur easily and the orbital revolution of the orbiting scroll (26) is made stable.

Next, the scroll compressor defined in a fourth aspect or a fifth aspect of the present invention defines the sliding direction of the Oldham coupling (39) based on a certain position (position where the gas reaction force becomes the greatest) of the orbital revolution of the orbiting scroll (26).

Specifically, according to the present invention defined in the fourth aspect, the first direction is determined so as to cross a straight line that passes through the centers (01,02) of both scrolls (24,26) at an angle of 60° to 120° on a plane perpendicular to the axis of the drive shaft (17) when the orbiting scroll (26) reaches to its revolutionary position where a reaction force of a gas in the compression chamber (40) during an orbital revolution of the orbiting scroll (26) becomes the greatest.

Further, according to the present invention defined in the fifth aspect, in the scroll compressor of the fourth aspect, the first direction of sliding movement of the Oldham coupling (39) is determined so as to cross the straight line that passes through the centers (01,02) of both scrolls (24,26) at an angle of substantially 90° on the plane perpendicular to the axis of the drive shaft (17) when the orbiting scroll (26) reaches to its revolutionary position where the reaction force of the gas in the compression chamber (40) during the orbital revolution of the orbiting scroll (26) becomes the greatest.

It can be said that the first rotational torque (T1) by the reaction force of gas compression, as described above, becomes the greatest when the gas pressure in the compression chamber (40) is the greatest, and the lateral-direction element of the gas reaction force acts in a certain direction that is substantially perpendicular to the line passing through the center (02) of the orbiting scroll (26) at this time and the center (01) of the fixed scroll (24). Accordingly, according to the present inventions of the fourth and fifth aspects, it is possible to make the sliding direction of the Oldham coupling (39) substantially reverse to the acting direction of gas reaction force at the above revolutionary angle, and thereby a situation can be made where the gas reaction force is offset substantially by the inertia force of the Oldham coupling (39). Thus, the range of fluctuation of the total rotational torque (T) is made smaller than that of the first rotational torque (T1) by the gas reaction force, and the orbiting scroll (26) can be prevented from rotating on its own axis in the reverse direction during the orbital revolution of the orbiting scroll (26). As a result, any vibration of the Oldham coupling (39) does not occur easily and the orbital revolution of the orbiting scroll (26) is made stable.

Further, according to the present invention defined in a sixth aspect of the present invention, in the scroll compressor of any one of the preceding aspects, the fixed scroll (24) and the orbiting scroll (26) are constituted in a asymmetric-volute structure having different length of volutes.

In general, the asymmetric-volute structure makes the range of fluctuation of the rotational torque (T) great due to imbalance of gas reaction force during the revolution, and thereby the Oldham coupling (39) tends to generate vibration easily. However, in the present invention defined in the sixth aspect, as described as to the inventions of the first through fifth aspects, the gas reaction force and the inertia force of the Oldham coupling (39) function so as to make the range of fluctuation of the rotational torque (T) small. Therefore, it is possible to prevent an occurring direction of the rotational torque (T) from reversing. Accordingly, even though it has the volute structure that tends to generate vibration easily, the vibration can be suppressed certainly.

According to the present invention defined in the first aspect, because the sliding direction of the Oldham coupling (39) is detennined so as to generate the function that the range of fluctuation of the total torque (T) by the reaction force of gas compression and the inertia force of sliding movement of the Oldham coupling (39) becomes smaller than that of the first rotational torque (T1) by gas compression, the orbiting scroll (26) can be prevented from rotating on its own axis in the reverse direction during the orbital revolution of the orbiting scroll (26). Thus, any vibration of the Oldham coupling (39) and any noise caused by this vibration do not occur easily, and the stable operation with less torque fluctuation can be obtained. Further, because there is no need to change the volute shape of the orbiting scroll (26) in this structure to suppress fluctuation of the rotational torque (T), any designing limitation of the compressing mechanism by the determination of the sliding direction of the Oldham coupling (39) can be also avoided without any deterioration of the desired function.

Further, according to the present invention defined in the second aspect, because the sliding direction (first direction) of the Oldham coupling (39) is determined so as to provide the phase difference of 150° to 210° between the cyclic fluctuation of the first rotational torque (T1) and the cyclic fluctuation of the second rotational torque (T2), it is possible to make the range of fluctuation of the total rotational torque (T) smaller than that of the first rotational torque (T1) and thereby the vibration and noise can be prevented.

Further, according to the present invention defined in the third aspect, because the above angle is determined at substantially 180° such that cyclic fluctuation of both torques are differed by ½ cycle from each other, the effect of the second aspect can be furthered.

Further, according to the present invention defined in the fourth aspect, because the first direction in which the Oldham coupling slides is determined so as to cross the straight line passing through the centers (01,02) of the fixed scroll (24) and the orbiting scroll (26) at the angle of 60° to 120° on the plane perpendicular to the axis when the orbiting scroll (26) reaches to its revolutionary position where the reaction force of the gas in the compression chamber (40) during the orbital revolution of the orbiting scroll (26) becomes the greatest, it is possible, like the invention defined in the second aspect, to make the range of fluctuation of the total rotational torque (T) smaller than that of the first rotational torque (T1) and thereby the vibration and noise can be prevented.

Further, according to the present invention defined in the fifth aspect, because the above angle is set at substantially 90° the cyclic fluctuation of both torques (T1, T2) are differed by ½ cycle from each other like the invention of the third aspect, and the range of fluctuation of the total rotational torque (T) can be suppressed certainly and thereby the effect of the fourth aspect can be furthered.

Further, according to the present invention defined in the sixth aspect, the range of fluctuation of the rotational torque (T) can be suppressed certainly in the asymmetric-volute structure in which the range of fluctuation of the rotation torque (T) tends to become great, and the occurring direction of the rotational torque (T) can be prevented from reversing. Further, the vibration and noise caused by the fluctuation of the rotational torque (T) of the scroll compressor having the asymmetric-volute structure can be suppressed certainly.

BEST MODE FOR CARRING OUT THE INVENTION

Figure 1:
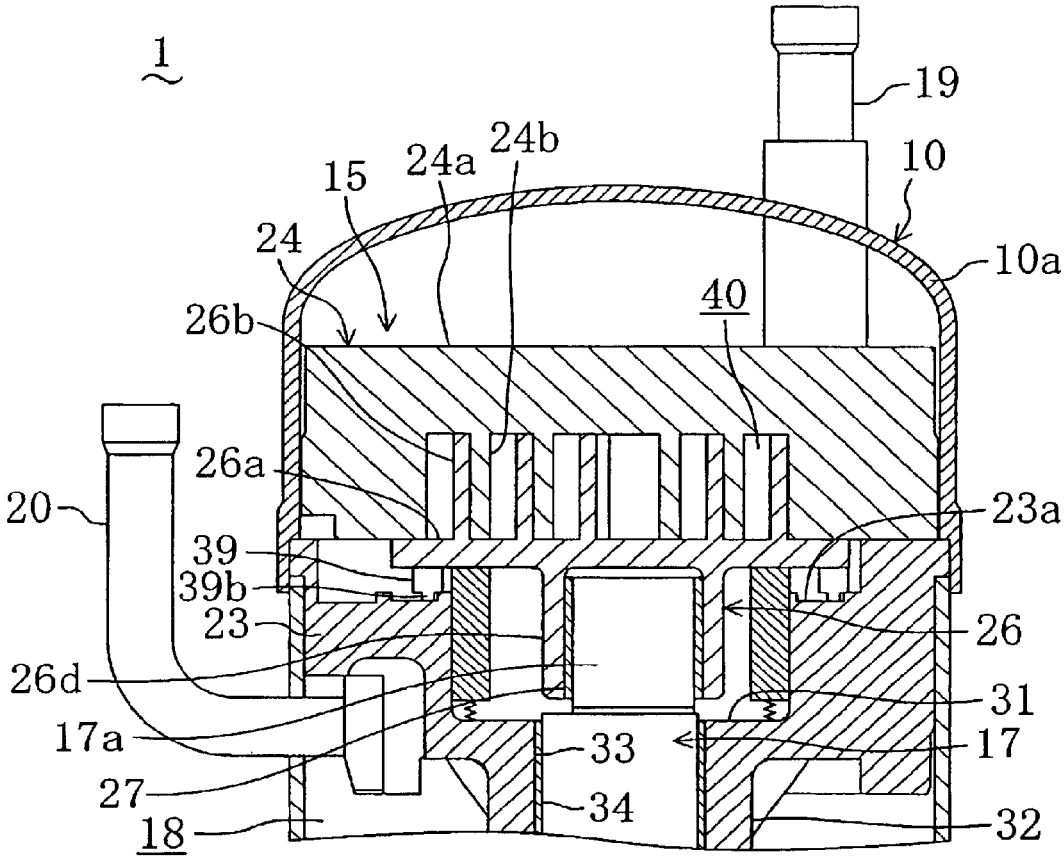
FIG. 1 is a partial sectional view of a scroll compressor according to an embodiment of the present invention.

An embodiment of the present invention will be described in detail with reference to the accompanying drawings. FIG. 1 shows a scroll compressor (1) according to the present embodiment. The scroll compressor (1) is connected to a refrigerating circuit, not shown in any drawing, which performs a vapor-compression type of refrigerating-cycle operation with a refrigerant circulated therein.

The scroll compressor (1) includes a sealed dome-type casing (10) with a longitudinal-cylinder shape. In the casing (10), a scroll compressing mechanism (15) to compress the refrigerant and a driving motor (not shown in any drawing) disposed below the scroll compressing mechanism (15) are installed. The scroll compressing mechanism (15) and the driving motor are coupled by a drive shaft (17) that is disposed in the casing (10) so as to extend in the vertical direction. Between the scroll compressing mechanism (15) and the driving motor, a high-pressure space (18) filled with a compressed gas refrigerant is provided.

The scroll compressing mechanism (15) includes a housing (23), a fixed scroll (24) and an orbiting scroll (26). The housing (23) is a fixing member to fix the compressing mechanism (15) to the casing (10), which is fixed to the casing (10) by pressure inserting at its entire outer-peripheral surface. The fixed scroll (24) is fixed to an upper face of the housing (23) so as to contact thereto. The orbiting scroll (26) is disposed between the fixed scroll (24) and the housing (23), which is constituted so as to be movable to the fixed scroll (24).

The housing (23) is provided with a housing recess (31) formed at the center of an upper face thereof, and a radial bearing portion (32) extending downwardly from the center of a lower face thereof. A pair of key grooves **(23*a*, 23*a*), which will be described later, are formed at the housing (23). A radial bearing hole (33) that penetrates from the lower-end face of the above radial bearing portion (32) to the bottom face of the housing recess (31) is also formed at the housing (23), by which the drive shaft (17) is supported through a sliding bearing (34)** so as to rotate freely therein.

The above casing (10) is closed by an upper end plate **(10*a*) at its upper-end portion. A suction pipe (19) to introduce the refrigerant in the refrigerating circuit into the scroll compressing mechanism (15) is connected to the upper end plate (10***a*) of the casing (10). Also, a discharge pipe (20) to discharge the high-pressure refrigerant in the casing (10) out of the casing (10) is connected to the center portion in the vertical direction of the casing (10). An inner-end portion of the suction pipe (19) is connected through the fixed scroll (24) to a compression chamber (40) that will be described later. The refrigerant is sucked into the compression chamber (40) from the suction pipe (19).

The fixed scroll (24) is comprised of an end plate (24*a*) and an involute wrap (24*b*) formed at a lower face of the end plate (24*a*). Meanwhile, the orbiting scroll (26) is comprised of an end plate (26*a*) and an involute wrap (26*b*) formed at an upper face of the end plate (26*a*). The wrap (24*b*) of the fixed scroll (24) and the wrap (26*b*) of the orbiting scroll (26) are engaged with each other. Further, the compression chamber (40) is formed between contacting portions of the both wraps (24*b*, 26*b*) of the fixed scroll (24) and the orbiting scroll (26).

Figure 2:
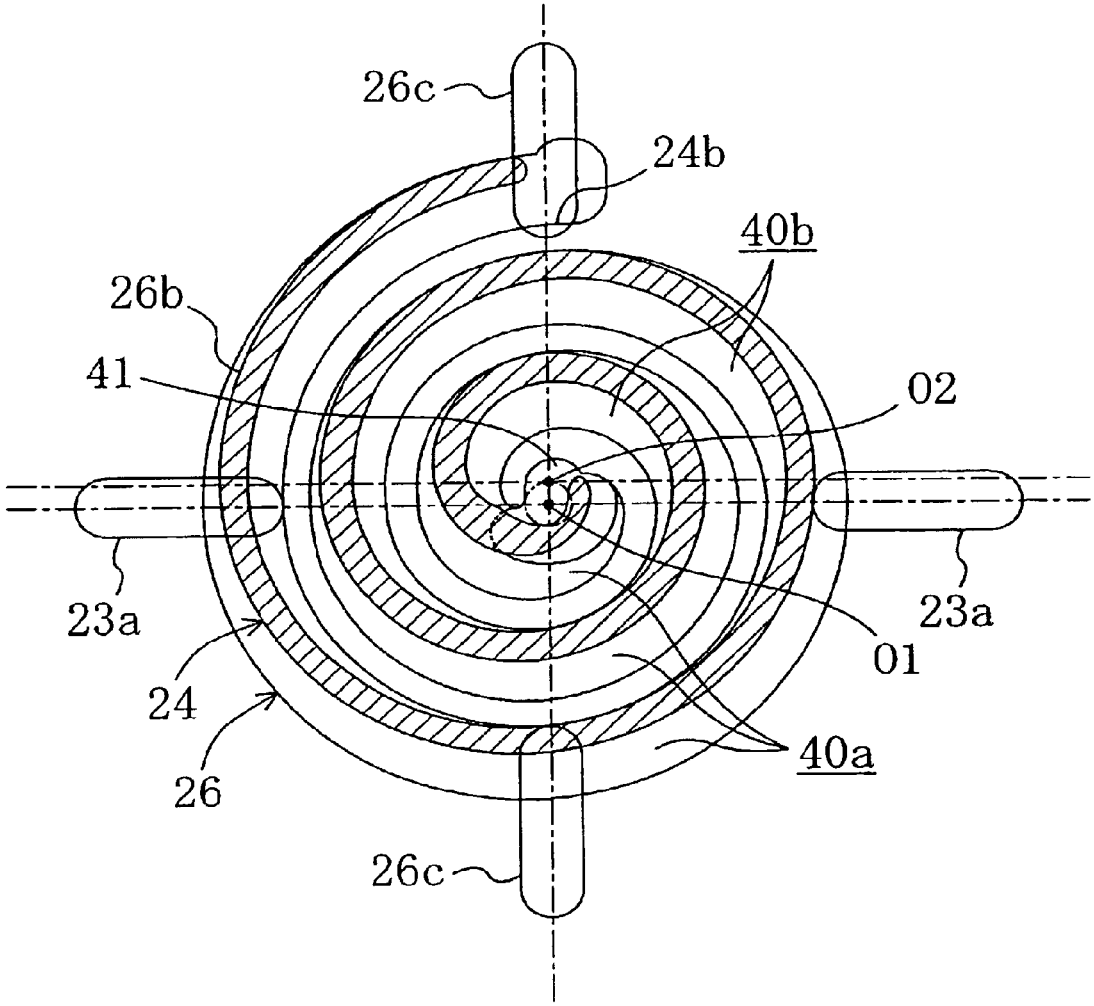
FIG. 2 is a sectional view for showing an essential part of an orbiting scroll that is located at a position where a refrigerant's reaction force in a compression chamber becomes the greatest.

The compression chamber (40), as shown in FIG. 2, is comprised of an outer-periphery-side compression chamber (40*a*), which is formed between an inner peripheral face of the wrap (24*b*) of the fixed scroll (24) and an outer peripheral face of the wrap (26*b*) of the orbiting scroll (26), and an inner-periphery-side compression chamber (40*b*), which is formed between an outer peripheral face of the wrap (24*b*) of the fixed scroll (24) and an inner peripheral face of the wrap (26*b*) of the orbiting scroll (26). In the present embodiment, the compressing mechanism (15) has an asymmetric-volute structure in which the length of the wrap (24*b*) of the fixed scroll (24) is different from that of the wrap (26*b*) of the orbiting scroll (26), and the outer-periphery-side compression chamber (40*a*) and the inner-periphery-side compression chamber (40*b*) are disposed asymmetrically against the center (01) of the fixed scroll (24).

Figure 4:
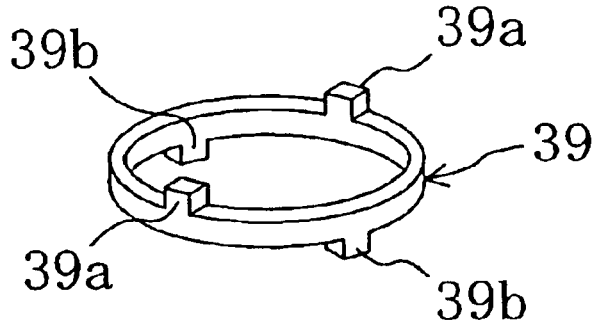
FIG. 4 is a perspective view of the Oldham coupling.

As shown in FIG. 1, the orbiting scroll (26) is supported at the housing (23) through an Oldham coupling (39). The Oldham coupling (39) is a ring-shape member that is made from, for example, aluminum, and it is constituted such that a pair of orbiting-scroll-side keys (39*a*, 39*a*) and a pair of housing-side keys (39*b*,39*b*) project respectively, as shown in FIG. 4. The orbiting-scroll-side keys (39*a*,39*a*) are formed at the obverse side of the Oldham coupling (39), while the housing-side keys (39*b*,39*b*) are formed at the reverse side of the Oldham coupling (39) so as to be located at a position which has a 90° different phase from the orbiting-scroll-side keys (39*a*,39*a*) to an axial center of the drive shaft (17).

Figure 3:
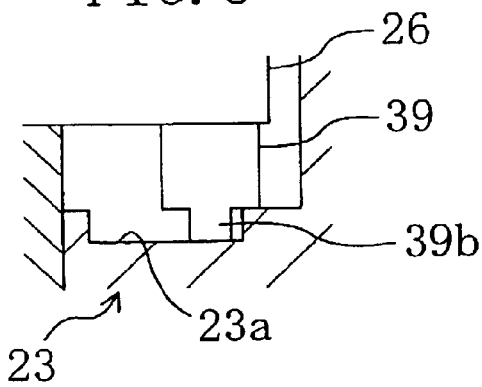
FIG. 3 is an enlarged sectional view for showing around a housing-side key of an Oldham coupling.
Figure 5:
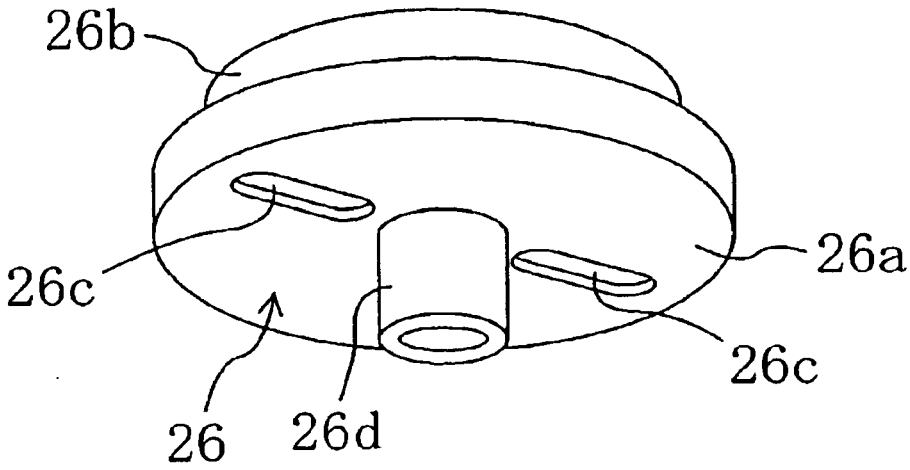
FIG. 5 is a perspective view of the orbiting scroll.

Meanwhile, as shown in FIG. 5, key grooves (26*c*,26*c*) are formed at the back of the orbiting scroll (26), corresponding to the orbiting-scroll-side keys (39*a*,39*a*). Further, as shown in the enlarged view of FIG. 3, key grooves (23*a*, 23*a*) are formed at the obverse of the housing (23), corresponding to the housing-side keys (39*b*, 39*b*). Then, two pair of key grooves (26*c*,23*a*) and the keys (39*a*,39*b*) are engaged with each other so as to constitute the Oldham coupling (39) that is capable of sliding in the first direction (lateral direction in FIG. 2), which is perpendicular to the axial center (rotational center) of the drive shaft (17), to the fixed scroll (24), and capable of sliding in the second direction (vertical direction in FIG. 2), which is perpendicular to the above axial center, to the orbiting scroll (26).

As shown in FIG. 1, a cylindrical boss (26*d*) is formed so as to project at the center of a lower face of the end plate (26*a*) of the orbiting scroll (26). Meanwhile, the drive shaft (17) is provided with an eccentric-shaft portion (17*a*) at its upper end. The eccentric-shaft portion (17*a*) is inserted in the boss (26*d*) of the orbiting scroll (26) through a sliding bearing (27) so as to rotate freely. Further, the drive shaft (17) is provided with a counter weight (not shown in any drawing) at a lower-side portion of the radial bearing portion (32) of the housing (23) to keep a dynamic balance with the orbiting scroll (26), the eccentric-shaft portion (17*a*) and the like. The drive shaft (17) rotates balancing weight by the counter weight.

With the rotation of the drive shaft (17), the Oldham coupling (39) slides reciprocatingly in the first direction to the fixed scroll (24) along the key grooves (23*a*,23*a*) at the side of housing (23), and the orbiting scroll (26) slides reciprocatingly in the second direction to the Oldham coupling (39) along the key grooves (26*c*,26*c*). As a result, the orbiting scroll (26) just revolves orbitally to the fixed scroll (24) without rotating on its own axis. At this time, the compression chamber (40) between the both wraps (24*b*, 26*b*) contracts toward the center thereof with the revolution of the orbiting scroll (26), thereby compressing the refrigerant sucked through the suction pipe (19).

Meanwhile, the scroll compressor (15) is provided with a gas passage (not shown in any drawing) that is formed over the fixed scroll (24) and the housing (23) so as to connect the compression chamber (40) and the high-pressure space (18). Accordingly, the high-pressure refrigerant compressed in the compression chamber (40) is discharged from a discharge hole (41) that is formed at an end portion of the above gas passage (see FIG. 2) to the high-pressure space (18) through the gas passage, and then flows out of the discharge pipe (20) into the refrigerating circuit.

In the involute shape of the wraps (24*b*,26*b*) according to the present embodiment, a revolutionary position of the orbiting scroll (26) where the pressure of the refrigerant in the compression chamber (40) becomes the greatest (this revolutionary position corresponds substantially to a revolutionary position where a first rotational torque (T1) by a reaction force of the refrigerant becomes the greatest) is located at about 90° (at the upper side of the center (01) of the fixed scroll (24)) as shown in FIG. 2, assuming that the revolutionary position is a standard (0°) when the center (02) of the orbiting scroll (26) is located at the right side of the center (01) of the fixed scroll (24) in FIG. 2.

The key grooves (23*a*, 23*a*) at the side of the housing (23) are formed at positions of 0° and 180°, respectively. Also, the key grooves (26*c*,26*c*) at the side of the orbiting scroll are formed at positions that are perpendicular to the key grooves (23*a*,23*a*) at the side of the housing (23), seeing from the center-line direction of the drive shaft (17), namely at positions of 90° and 270° in the drawing.

The Oldham coupling (39) executes a reciprocating sliding-movement to the fixed scroll (24) along the key grooves (23*a*, 23*a*) at the side of the housing (23). Accordingly, the sliding direction (first direction) of the Oldham coupling (39) crosses the straight line that passes through the centers (01, 02) of the both scrolls (24, 26) at a state shown in FIG. 2 where the first rotational torque (T1) becomes almost the greatest, at an angle of substantial 90° on a plane that is perpendicular to the axis of the drive shaft (17). An inertia force (F0) of the Oldham coupling (39) becomes the greatest at its middle position of the reciprocating sliding-movement. Accordingly, in the above positional relationship, when the revolutionary position of the orbiting scroll (26) is at positions of 90° and 270°, the absolute value of the inertia force (F0) becomes the greatest.

Next, an operation state of the scroll compressor (1) according to the present embodiment will be described. The drive shaft (17) rotates with starting of the driving motor, and its driving power is conveyed to the orbiting scroll (26) of the scroll compressing mechanism (15). At this time, the eccentric-shaft portion (17*a*) of the drive shaft (17) revolves on a certain revolutionary orbit, while the Oldham coupling (39) slides in the first direction to the fixed scroll (24) by the function of the key (39*b*) and the key groove (23*a*) and the orbiting scroll (26) slides in the second direction to the Oldham coupling (39) by the function of the key (39*a*) and the key groove (26*c*), and therefore the orbiting scroll (26) revolves orbitally without rotating on its own axis.

Thereby, a low-pressure gas refrigerant that has been evaporated at an evaporator in the refrigerating circuit not shown in any drawing is sucked into the compression chamber (40) from the peripheral-edge side of the compression chamber (40) through the suction pipe (19). The refrigerant is compressed and increases in pressure with changing of the displacement of the compression chamber (40) in the scroll compressing mechanism (15), and then it flows into the high-pressure space (18) through the discharge hole (41) and the gas passage. When discharged out of the casing (10) from the discharge pipe (20), the refrigerant circulates in the refrigerating circuit and then is sucked again into the scroll compressor (1) through the suction pipe (19). This operation is repeated in the present embodiment.

Meanwhile, during the orbital revolution of the orbiting scroll (26), a refrigerant's reaction force that may enlarge the outer-periphery-side compression chamber (40*a*) and the inner-periphery-side compression chamber (40*b*) due to the refrigerant compressed in the compression chamber (40) acts on the orbiting scroll (26).

Figure 6:
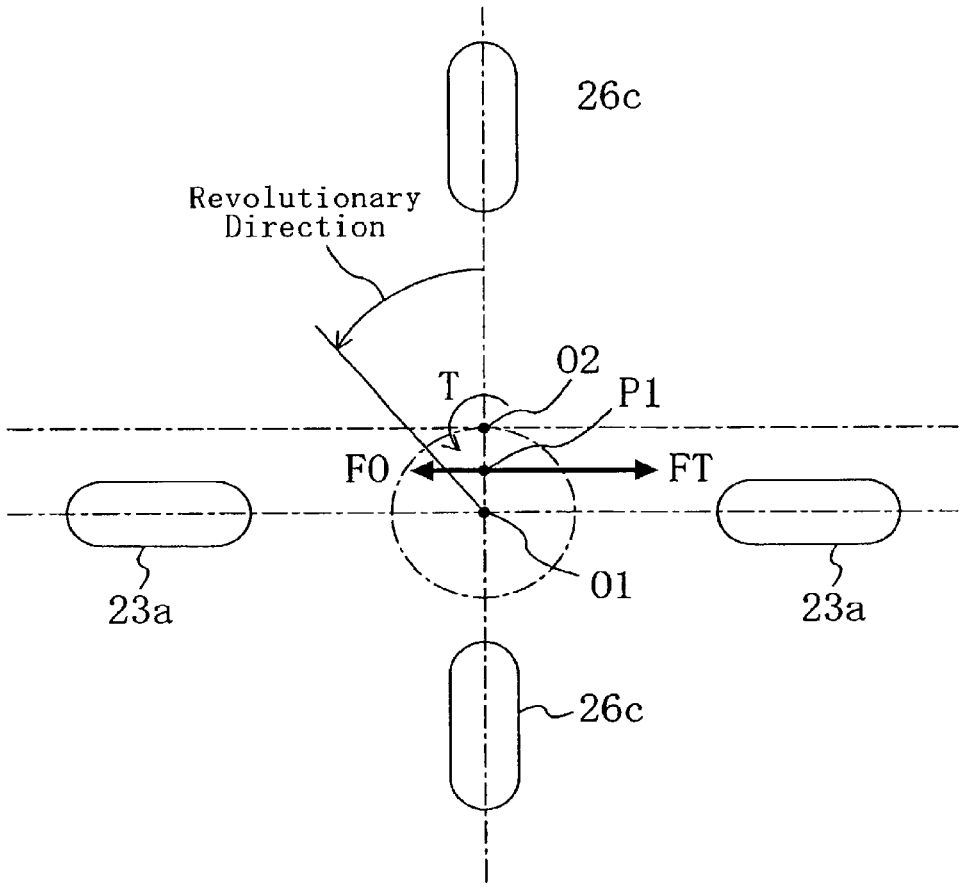
FIG. 6 is an explanatory diagram for showing a state where a rotational torque of the orbiting scroll occurs.

The above refrigerant's reaction force is comprised of a lateral-direction load and an axial-direction load. The function of the lateral-direction load (FT) is shown in FIG. 6 in simplified way. Assuming that the lateral-direction load (FT) acts on one point (hereinafter, referred to as acting point (P1)) on the straight line connecting the center (02) of the orbiting scroll (26) with the center (01) of the fixed scroll (24) as shown in this figure, the first rotational torque (T1) by the refrigerant's reaction force is determined by multiplying the lateral-direction load (FT) by the distance between the center (01) of the fixed scroll (24) and the acting point (P1). The first rotational torque (T1) becomes the greatest at the revolutionary position where the reaction force of the refrigerant compressed in the compression chamber (40) during the orbital revolution of the orbiting scroll (24) becomes the greatest, and at this time the lateral-direction load (FT) acts in the direction that is substantially perpendicular to the straight line passing through the centers (01, 02) of the fixed scroll (24) and the orbiting scroll (26).

Meanwhile, the rotational torque (T) of the orbiting scroll (26), as described above, is the sum of the first rotational torque (T1) by the refrigerant's reaction force and moments by other aspects. In the present embodiment, defining the sliding direction (first direction) of the Oldham coupling (39), which is one of factors for the fluctuation, as described above makes the inertia force (F0) act in the opposite direction to the lateral-direction load (FT) by the refrigerant's reaction force, result in suppressing a fluctuation of the total torque (T).

Specifically, when the revolutionary position of the orbiting scroll (26) is located at the position of 90° in FIGS. 2 and 6, the lateral-direction element (FT) by the refrigerant's reaction force with its greatest value acts on the orbiting scroll (26) in the right direction in FIG. 6, while the Oldham coupling (39) is under movement in the left direction in the figure along the key grooves (23*a*,23*a*) at the side of the housing (23) with the orbital revolution of the orbiting scroll (26) and the inertia force (F0) becomes the greatest at this time. Accordingly, because the refrigerant's reaction force (FT) and the inertia force (F0) act in the opposite directions to each other with their greatest value, they act so as to offset each other and thereby the maximum value of the total rotational torque (T) acting on the orbiting scroll (26) becomes small.

According to this, the phase difference between the cyclic fluctuation of the first rotational torque (T1) by the gas reaction force and the cyclic fluctuation of the second rotational torque (T2) by the sliding movement of the Oldham coupling (39) becomes substantial 180° as shown later. Thus, the range of fluctuation of the total torque (T) of the first rotational torque (T1) and the second rotational torque (T2) is contracted so as to be smaller than that of the first rotational torque (T1).

Accordingly, the total rotational torque (T) acting on the orbiting scroll (26) is made stable, any force to turn the orbiting scroll (26) reversely does not occur easily, and any shaking between the keys (39*a*,39*b*) of the Oldham coupling (39) and the key grooves (26*c*,23*a*) of the orbiting scroll and the housing does not occur easily either. Thus, it is possible to prevent the noise and the vibration of the scroll compressor (1) from occurring.

Herein, the present embodiment is constituted such that the line connecting the center (02) of the orbiting scroll (26) with the center (01) of the fixed scroll (24) when the refrigerant's reaction force becomes the greatest crosses the first direction of sliding of the Oldham coupling (39) at an angle of 90°. However, the crossing angle may be changed in the present invention, as long as the range of fluctuation of the total rotational torque (T) becomes smaller than that of the first rotational torque (T1).

Next, the first direction in which the Oldham coupling (39) slides to the fixed scroll (24) will be described in detail with a comparative sample.

Figure 7:
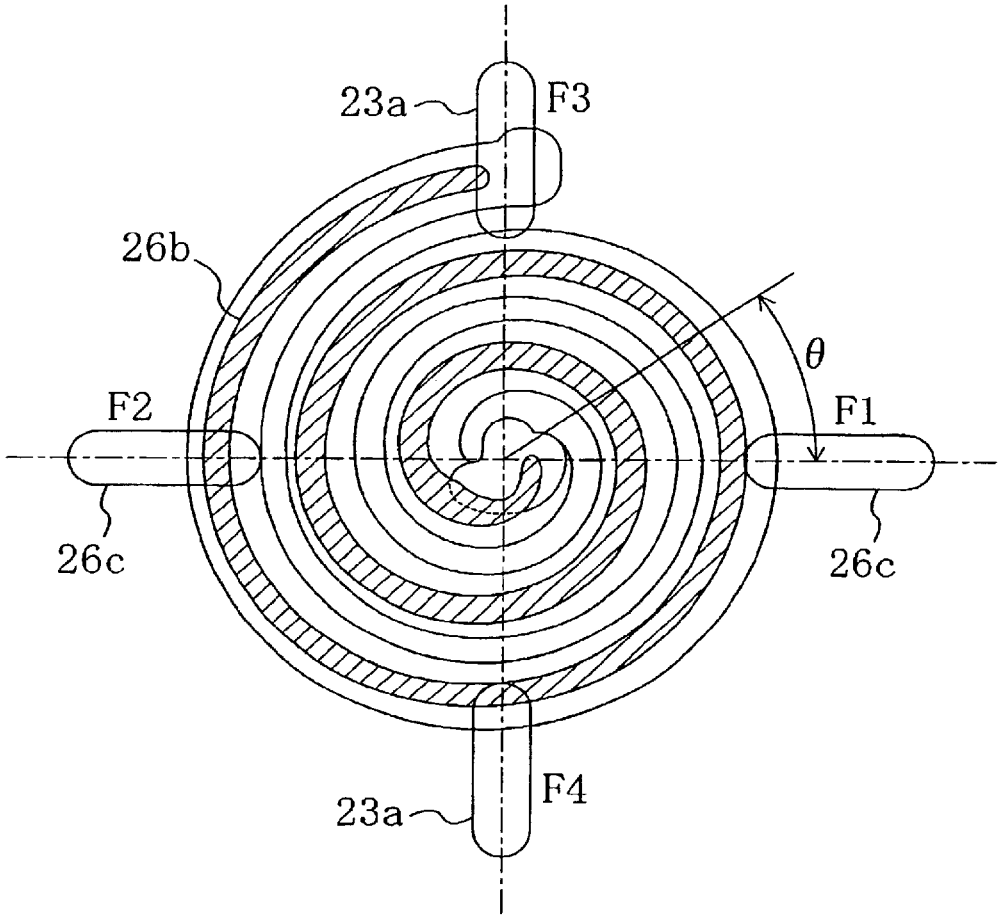
FIG. 7 is a sectional view for showing an essential part of a scroll compressor according to a comparative sample.

In the comparative sample, the positional angle of the two pair of keys (39*a*, 39*b*) and the key grooves (26*c*, 23*a*) are different from that of the above embodiment by 90°. Namely, in the comparative sample, as shown in FIG. 7, the key grooves (26*c*, 26*c*) of the orbiting scroll (26) are located at the positions which are equivalent to the revolutionary position of the orbiting scroll (26) of 0° and 180°, while the key grooves (23*a*, 23*a*) at the side of the housing (23) are located at the positions equivalent to that of 90° and 270°. In this structure, the orbiting scroll (26) is constituted such that the direction of the line connecting the center (02) of the orbiting scroll (26) with the center (01) of the fixed scroll (24) when the first rotational torque (T1) by the refrigerant's compression becomes the greatest corresponds to the first direction of sliding of the Oldham coupling (39) (sliding direction to the fixed scroll (24)).

Figure 8:
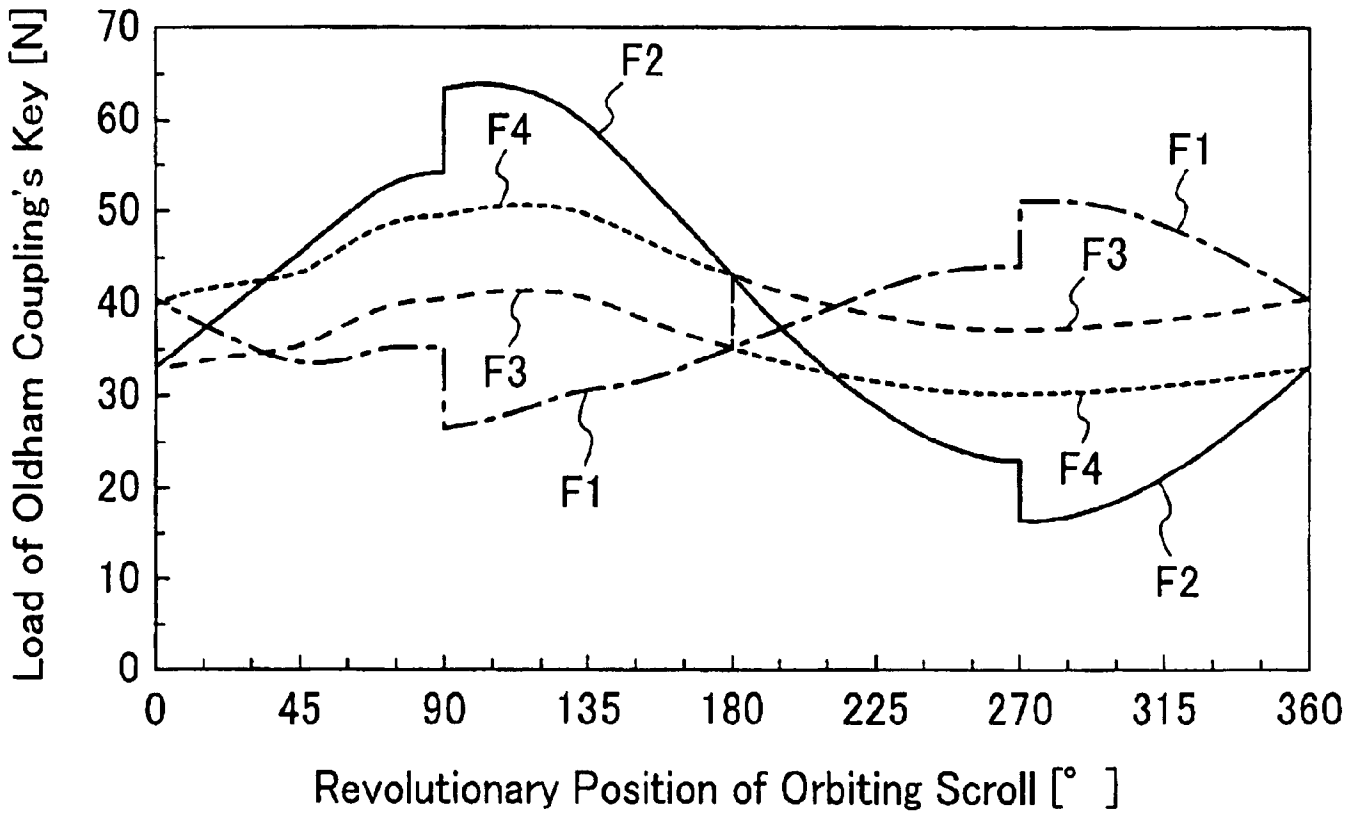
FIG. 8 is a graph for showing a state in which load acting on each key of the Oldham coupling fluctuates according to a revolutionary position.

In this structure, load characteristics by the inertia force acting on respective keys (39*a*,39*a*) of the Oldham coupling (39) with the orbiting scroll (26) rotated at a speed of 60 revolutions per second was investigated. In FIG. 8, loads (F1–F4) show the loads occurring on respective orbiting-scroll-side keys (39*a*,39*a*) at 0°, 180° and respective housing-side keys (39*b*,39*b*) at 90° and 270°, in order. These loads (F1–F4) having their negative values have a risk to reverse the rotational torque (T). The load (F2) acting on the orbiting-scroll-side key (39*a*) at the position of 180° in the above loads (F1–F4) is the one having the smallest value thereof, which is considered to have a high risk to reverse the rotational torque (T). Herein, the load (F2) will be examined.

Figure 9:
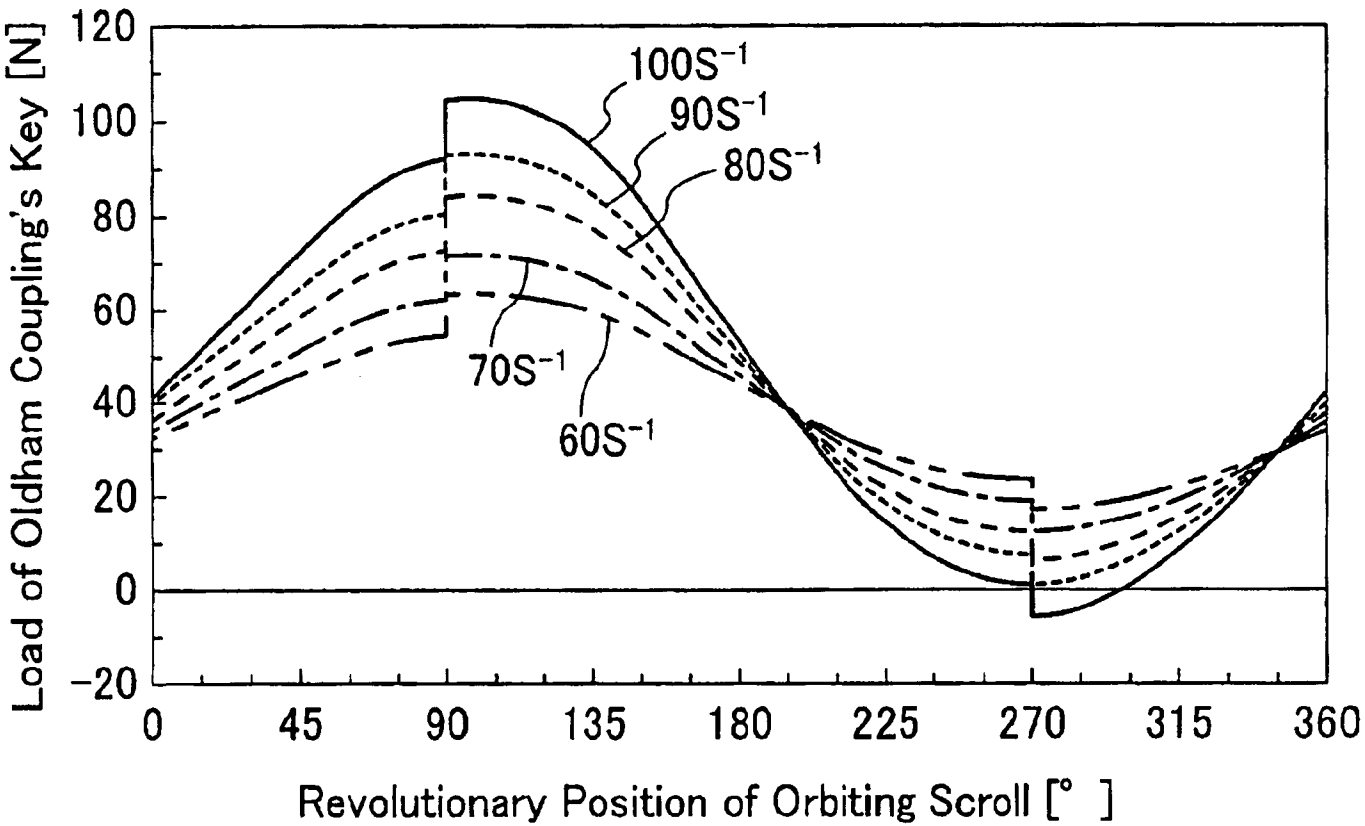
FIG. 9 is a graph for showing a state in which load denoted by F2 in FIG. 8 fluctuates according to a rotational speed.

Firstly, the load (F2) acting on the orbiting-scroll-side key (39*a*) at the position of 180° was examined by changing the speed of the orbiting scroll (26) from 60 to 100 revolutions per second. FIG. 9 shows results. As shown in this figure, a state can be understood where the range of fluctuation of the load (F2) enlarged with the speed increasing and the load (F2) turned to a negative value at the revolutionary position of the orbiting scroll (26) of 270° especially after the speed exceeded 90 revolutions per second. Accordingly, there arises a high risk at this point that the acting direction of the rotational torque (T) reverses. Once reversing of the rotational torque (T) arises, the keys (39*a*,39*b*) of the Oldham coupling (39) hit one time at the key grooves (23*a*,26*c*) during one orbital revolution of the orbiting scroll (26), thereby causing noise and vibration of the scroll compressor (1).

Figure 10:
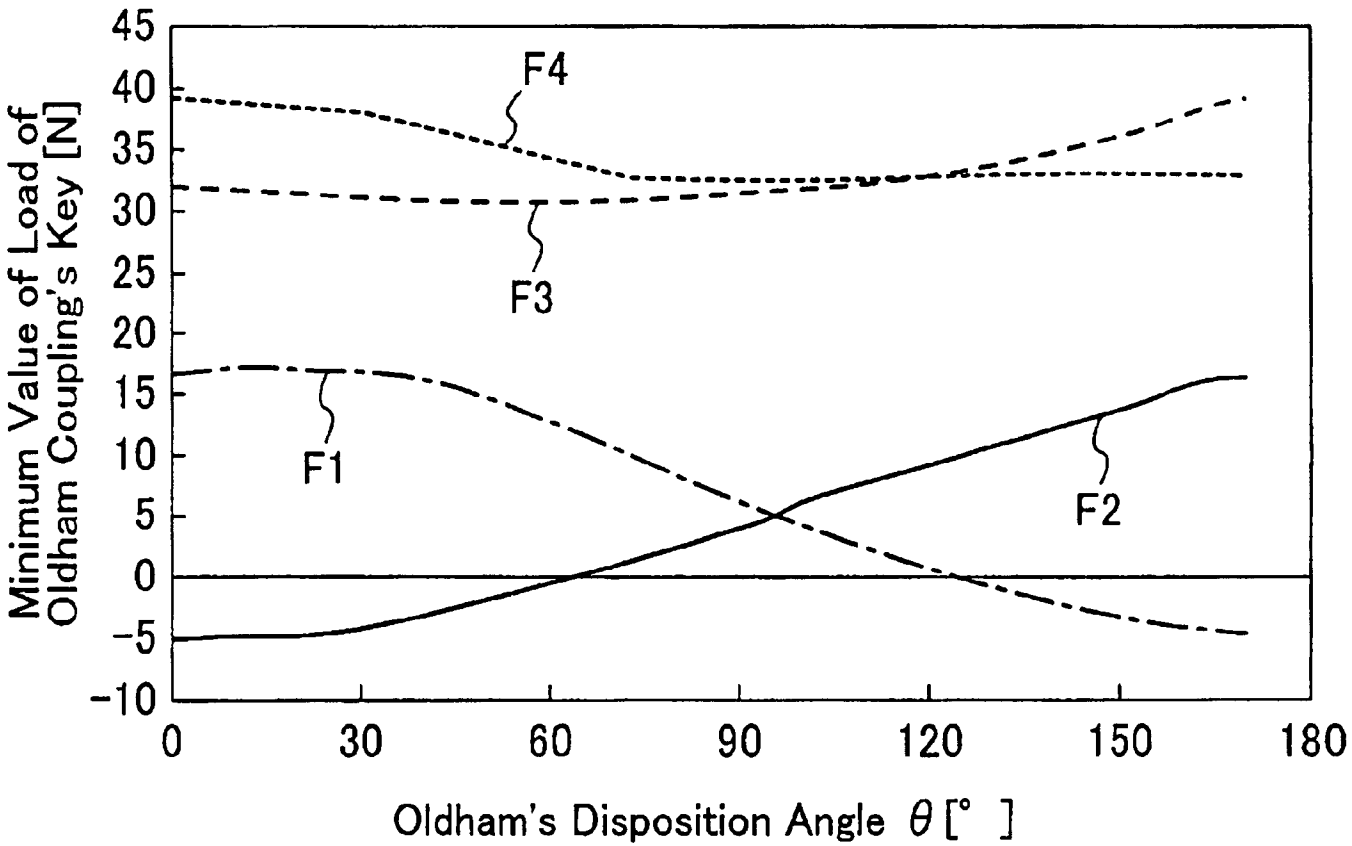
FIG. 10 is a graph for showing a state in which a minimum value of the load acting on each key of the Oldham coupling in the present embodiment fluctuates according to a sliding direction of the Oldham coupling.

Now, a disposition angle (θ) of the keys (39*a*, 39*b*) the Oldham coupling (39) that is appropriate to suppress the above vibration will be examined. Firstly, setting the deposition angle (θ) of the keys (39*a*, 39*b*) of the comparative sample at the standard (0°), each fluctuation of the loads (F1–F4) was analyzed by changing the disposition angle in the range of from 0° to 180°. FIG. 10 shows results.

As shown in FIG. 10, the load (F1) became negative values in the range of the disposition angle (θ) that is greater than 120°, while the load (F2) became negative values in the range of the disposition angle (θ) that is smaller than 60°. Accordingly, it can be considered that in a range excluding the above angles (range between 60° and 120°) the total torque (T) may not reverse and thereby the noise and vibration of the scroll compressor (1) can be suppressed because the loads have always their positive values therein. In other words, it can be understood that the disposition angle (θ) of the keys (39*a*,39*b*) should be set appropriately in a range that is 30° above and below the disposition angle of the above embodiment.

Accordingly, it can be understood that the first direction of sliding of the Oldham coupling (39) should be set appropriately so as to cross the straight line that passes through the centers (01,02) of the fixed scroll (24) and the orbiting scroll (26) at the revolutionary position where the reaction force of the gas compressed in the compression chamber (40) between the both scrolls (24,26) becomes the greatest during the orbital revolution of the orbiting scroll (26), at an angle within 60° to 120° on the plane which is perpendicular to the rotational axial center of the drive shaft (17). Namely, it is the best to set the first direction at the position of 90° to the above straight line (position where the phase difference between respective fluctuation of the first rotational torque (T1) and the second rotational torque (T2) becomes 180°), and it is appropriate to set in a range that is 30° above and below the above position.

According to this, the phase difference between the cyclic fluctuation of the first rotational torque (T1) acting on the orbiting scroll (26) by the reaction force of the gas compressed in the compression chamber (40) during the orbital revolution of the orbiting scroll (26) and the cyclic fluctuation of the second rotational torque (T2) by the sliding movement in the first direction of the Oldham coupling (39) becomes about a half of cycle (180°±30°). Accordingly, the first rotational torque (T1) and the second rotational torque (T2) act so as to offset the fluctuation range of each other, and thereby reversing of the total rotational torque (T) can be prevented and the noise and vibration of the scroll compressor (1) can be suppressed.

Industrial Applicability

As described above, the present invention is useful for the scroll compressor.

What is claimed is:

1. A scroll compressor comprising:

a casing having a fixed scroll, an orbiting scroll and an Oldham coupling therein, said orbiting scroll forming a compression chamber together with said fixed scroll, said Oldham coupling being configured to slide in a first direction that is perpendicular to an axis of a drive shaft to said fixed scroll and being configured to slide in a second direction that is perpendicular to said axis of said drive shaft to said orbiting scroll, said first direction being determined so as to provide a phase difference between a first rotational torque acting on said orbiting scroll with cyclic fluctuation by a reaction force of a gas in said compression chamber during an orbital revolution of said orbiting scroll and a second rotational torque acting on said orbiting scroll with cyclic fluctuation by sliding movement of said Oldham coupling in said first direction, such that a range of fluctuation of a total torque of said first rotational torque and said second rotational torque becoming smaller than that of said first rotational torque.

2. The scroll compressor of claim 1, wherein said fixed scroll and said orbiting scroll are constituted in a asymmetric-volute structure having different length volutes.

3. A scroll compressor comprising:

a casing having a fixed scroll, an orbiting scroll and an Oldham coupling therein, said orbiting scroll forming a compression chamber together with said fixed scroll, said Oldham coupling being configured to slide in a first direction that is perpendicular to an axis of a drive shaft to said fixed scroll and being configured to slide in a second direction that is perpendicular to said axis of said drive shaft to said orbiting scroll, said first direction being determined so as to provide a phase difference of 150° to 210° between a cyclic fluctuation of a first rotational torque acting on said orbiting scroll by a reaction force of a gas in said compression chamber during an orbital revolution of said orbiting scroll and a cyclic fluctuation of a second rotational torque by sliding movement of said Oldham coupling in said first direction.

4. The scroll compressor of claim 3, wherein said first direction is determined so as to provide said phase difference at substantially 180° between said cyclic fluctuation of said first rotational torque and said cyclic fluctuation of said second rotational torque.

5. The scroll compressor of claim 3, wherein said fixed scroll and said orbiting scroll are constituted in a asymmetric-volute structure having different length volutes.

6. The scroll compressor of claim 4, wherein said fixed scroll and said orbiting scroll are constituted in a asymmetric-volute structure having different length volutes.

7. A scroll compressor comprising:

a casing having a fixed scroll, an orbiting scroll and an Oldham coupling therein, said orbiting scroll forming a compression chamber together with said fixed scroll, said Oldham coupling being configured to slide in a first direction that is perpendicular to an axis of a drive shaft to said fixed scroll and being configured to slide in a second direction that is perpendicular to said axis of said drive shaft to said orbiting scroll, said first direction being determined so as to cross a straight line passing through centers of said fixed and orbiting scrolls at an angle of 60° to 120° on a plane perpendicular to said axis of said drive shaft when said orbiting scroll reaching a revolutionary position where a reaction force of a gas in said compression chamber during an orbital revolution of said orbiting scroll becoming greatest.

8. The scroll compressor of claim 7, wherein said first direction is determined so as to cross said straight line at an angle of substantially 90° on said plane perpendicular to said axis of said drive shaft when said orbiting scroll reaches said revolutionary position.

9. The scroll compressor of claim 7, wherein said fixed scroll and said orbiting scroll are constituted in a asymmetric-volute structure having different length volutes.

10. The scroll compressor of claim 8, wherein said fixed scroll and said orbiting scroll are constituted in a asymmetric-volute structure having different length volutes.

* * * * *